US009368930B2

(12) United States Patent
Smith et al.

(10) Patent No.: US 9,368,930 B2
(45) Date of Patent: Jun. 14, 2016

(54) ATTACHABLE AND REMOVABLE PROTECTIVE RUGGED HOOD ASSEMBLY FOR AN ELECTRICAL CONNECTOR AND METHOD OF USE

(71) Applicants: Jason Smith, Sartell, MN (US); Emad Soubh, Camas, WA (US)

(72) Inventors: Jason Smith, Sartell, MN (US); Emad Soubh, Camas, WA (US)

(73) Assignee: AIRBORN, INC., Georgetown, TX (US)

( * ) Notice: Subject to any disclaimer, the term of this patent is extended or adjusted under 35 U.S.C. 154(b) by 18 days.

(21) Appl. No.: 13/676,045

(22) Filed: Nov. 13, 2012

(65) Prior Publication Data

US 2014/0134866 A1 May 15, 2014

(51) Int. Cl.

| | |
|---|---|
| ***H01R 13/52*** | (2006.01) |
| ***H01R 43/20*** | (2006.01) |
| ***H01R 13/516*** | (2006.01) |
| *H01R 12/73* | (2011.01) |

(52) U.S. Cl.

CPC ..... *H01R 43/20* (2013.01); *H01R 13/516* (2013.01); *H01R 12/73* (2013.01); *Y10T 29/49208* (2015.01); *Y10T 29/49815* (2015.01)

(58) Field of Classification Search

CPC ..... H01R 43/20; H01R 13/516; H01R 12/73; Y10T 29/49208

USPC ..... 439/278, 752, 499, 352, 607.32, 398, 439/78; 29/883–884, 874, 876

See application file for complete search history.

(56) References Cited

U.S. PATENT DOCUMENTS

| | | | | | |
|---|---|---|---|---|---|
| 4,255,009 | A | * | 3/1981 | Clark | 439/398 |
| 4,310,208 | A | * | 1/1982 | Webster et al. | 439/494 |
| 4,426,127 | A | * | 1/1984 | Kubota | 439/607.17 |
| 4,758,182 | A | * | 7/1988 | Anbo et al. | 439/592 |
| 4,921,448 | A | * | 5/1990 | Endo et al. | 439/595 |
| 4,946,398 | A | * | 8/1990 | Takenouchi et al. | 439/599 |
| 4,975,082 | A | * | 12/1990 | Nagasaka et al. | 439/595 |
| 4,984,998 | A | * | 1/1991 | Duncan et al. | 439/352 |
| 5,059,142 | A | * | 10/1991 | Ohta et al. | 439/752 |
| 5,141,452 | A | * | 8/1992 | Yoneda et al. | 439/595 |
| 5,249,982 | A | * | 10/1993 | Funck et al. | 439/556 |
| 5,295,871 | A | * | 3/1994 | Lapraik et al. | 439/746 |
| 5,472,354 | A | * | 12/1995 | Chen | H01R 12/732 439/357 |
| 5,554,055 | A | * | 9/1996 | Miller | 439/752 |
| 5,580,283 | A | * | 12/1996 | O'Sullivan et al. | 439/686 |
| 5,660,555 | A | * | 8/1997 | Ito et al. | 439/278 |
| 5,906,511 | A | * | 5/1999 | Bozzer et al. | 439/579 |
| 6,155,887 | A | | 12/2000 | Cuff et al. | |
| 6,217,374 | B1 | * | 4/2001 | O'Sullivan | 439/499 |
| 6,220,869 | B1 | | 4/2001 | Grant et al. | |
| 6,299,482 | B1 | * | 10/2001 | Huang | 439/607.32 |
| 6,318,632 | B1 | | 11/2001 | Grant et al. | |
| 6,877,992 | B2 | | 4/2005 | Grant et al. | |
| 7,021,942 | B2 | | 4/2006 | Grant et al. | |
| 7,187,076 | B2 | | 3/2007 | Cuff et al. | |
| D543,508 | S | | 5/2007 | Dever | |
| D549,659 | S | | 8/2007 | Dever | |
| D560,613 | S | | 1/2008 | McEvoy et al. | |

(Continued)

*Primary Examiner* — Jean F Duverne

(74) *Attorney, Agent, or Firm* — Locke Lord LLP

(57) ABSTRACT

An attachable and removable protective rugged hood assembly for an electrical connector, including board-mounted electrical connectors. The rugged hood assembly comprises a male connector hood portion and a female connector hood portion. The rugged hood assembly allows standard electrical connectors to be used in harsh conditions, such as in military equipment, and also provides electromagnetic interference ("EMI") shielding.

13 Claims, 5 Drawing Sheets

(56) References Cited

U.S. PATENT DOCUMENTS

| | | | |
|---|---|---|---|
| D560,614 | S | 1/2008 | McEvoy et al. |
| D561,103 | S | 2/2008 | Grant |
| D561,107 | S | 2/2008 | Cuff et al. |
| D561,108 | S | 2/2008 | Cuff et al. |
| D561,109 | S | 2/2008 | Howerton et al. |
| D561,110 | S | 2/2008 | Howerton et al. |
| D561,698 | S | 2/2008 | Cuff et al. |
| D562,248 | S | 2/2008 | Howerton et al. |
| D562,249 | S | 2/2008 | Howerton et al. |
| D563,877 | S | 3/2008 | Grant |
| D563,878 | S | 3/2008 | Grant |
| D563,879 | S | 3/2008 | Grant |
| D563,880 | S | 3/2008 | Grant |
| D563,881 | S | 3/2008 | Howerton et al. |
| D563,882 | S | 3/2008 | Howerton et al. |
| D563,883 | S | 3/2008 | Dever |
| D563,884 | S | 3/2008 | Dever |
| D563,885 | S | 3/2008 | Dever |
| D563,886 | S | 3/2008 | Dever |
| D563,887 | S | 3/2008 | Dever |
| 2010/0099279 | A1* | 4/2010 | Homme et al. ..... 439/78 |

* cited by examiner

ATTACHABLE AND REMOVABLE PROTECTIVE RUGGED HOOD ASSEMBLY FOR AN ELECTRICAL CONNECTOR AND METHOD OF USE

BACKGROUND OF THE INVENTION

1. Field of Invention

The present invention is directed to an attachable and removable protective rugged hood assembly comprising an intermateable pair of attachable and removable rugged hood portions that can convert a standard electrical connector to a rugged connector for harsh conditions and rugged environments and to a method of use.

2. Description of Related Art

Other hoods that are used to make a connector more durable or rugged, in particular cable hoods, cannot be slipped on or off before and after mounting. Such hoods are described, for example, in U.S. Pat. Nos. 4,460,230 and 3,148,928. Thus, there is a need in the art for an improved and versatile hood for electrical connectors.

SUMMARY

The present invention is an attachable and removable protective rugged hood assembly for an electrical connector and a method of use. The rugged hood assembly comprises a male connector hood portion and a mating, female connector hood portion. The hood portions contain apertures through which the electrical connector passes during installation. The rugged hood assembly can be installed and removed before or after the mounting of the connector to a board. The present invention allows the use of otherwise standard electrical connectors in harsh conditions, such as in military equipment, and also provides electromagnetic interference ("EMI") shielding.

BRIEF DESCRIPTION OF THE DRAWINGS

The apparatus of the invention is further described and explained in relation to the following figures of the drawing wherein.

DETAILED DESCRIPTION OF THE PREFERRED EMBODIMENTS

Figure 1:
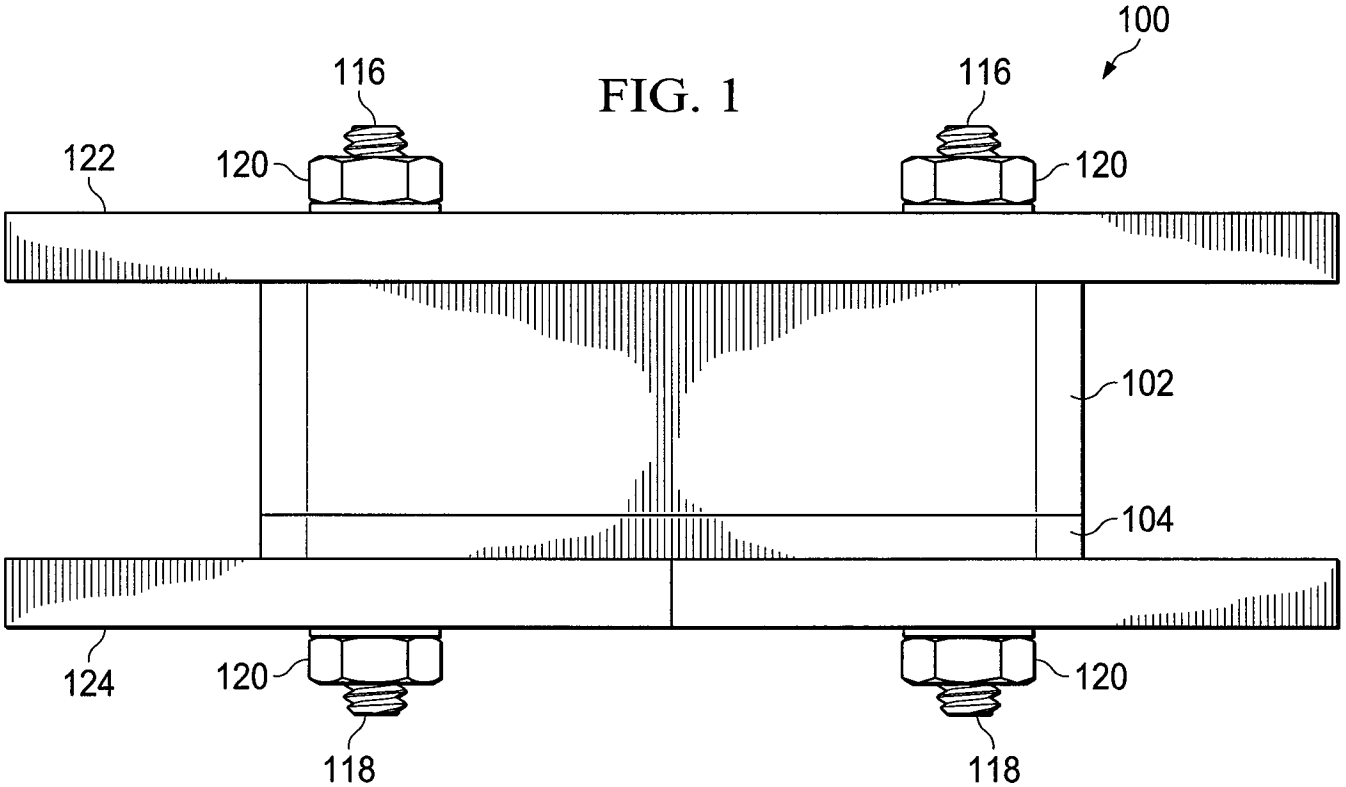
FIG. 1 is a side elevation view of a rugged hood assembly installed on mated pair of electrical connectors, which are each mounted on printed circuit boards.
Figure 2:
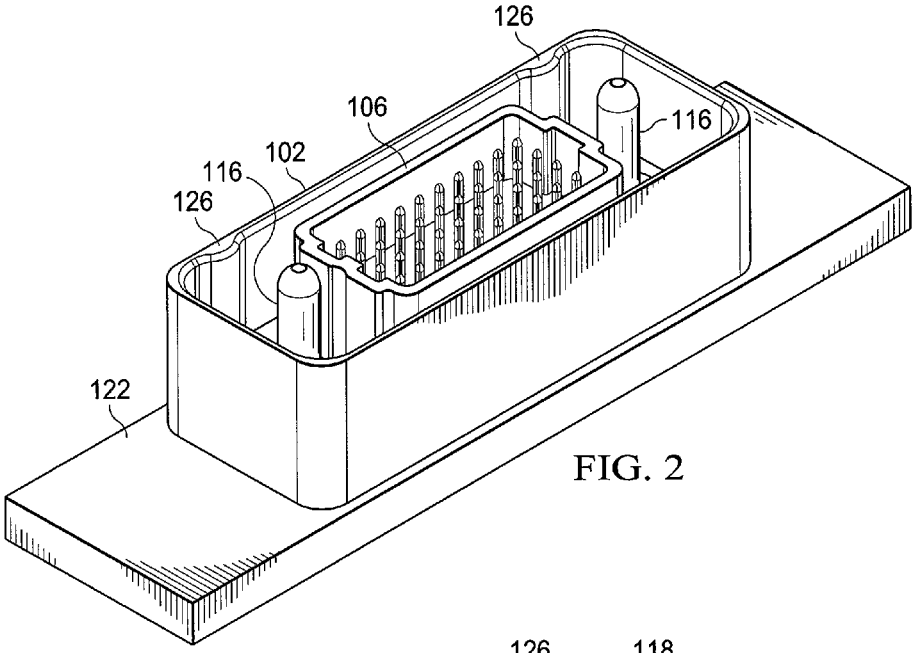
FIG. 2 is a top perspective view of a male connector hood portion installed on a male electrical connector mounted to a first board.
Figure 3:
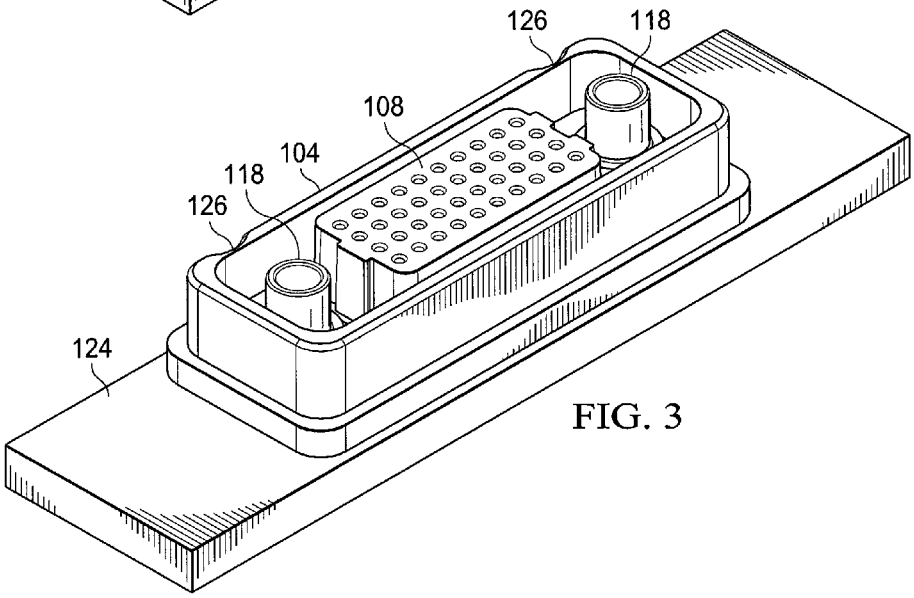
FIG. 3 is a top perspective view of a female connector hood portion installed on a female electrical connector mounted to a second board.
Figure 4:
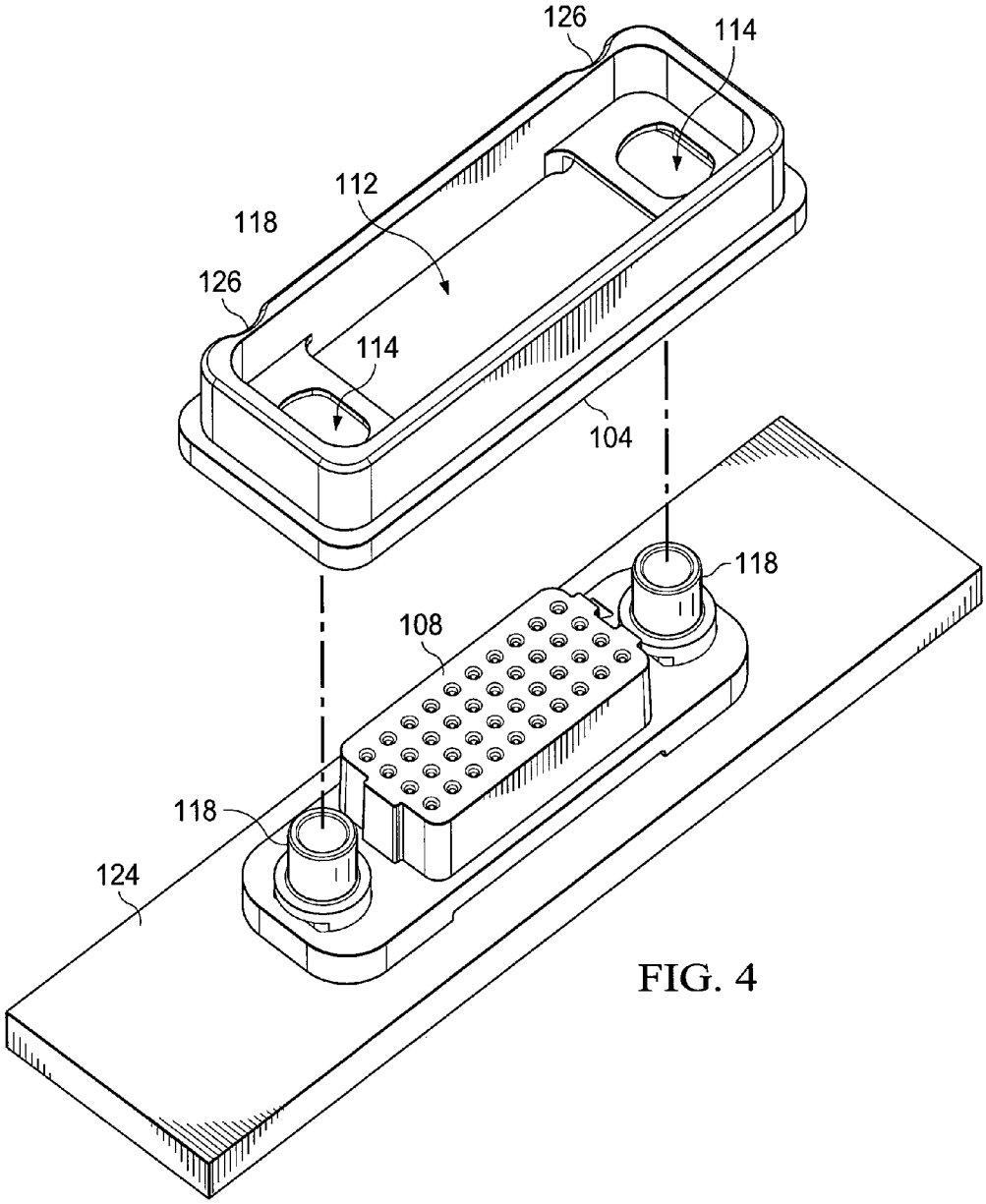
FIG. 4 is a top perspective view of a female connector hood portion removed from a female electrical connector mounted to a second board.
Figure 5:
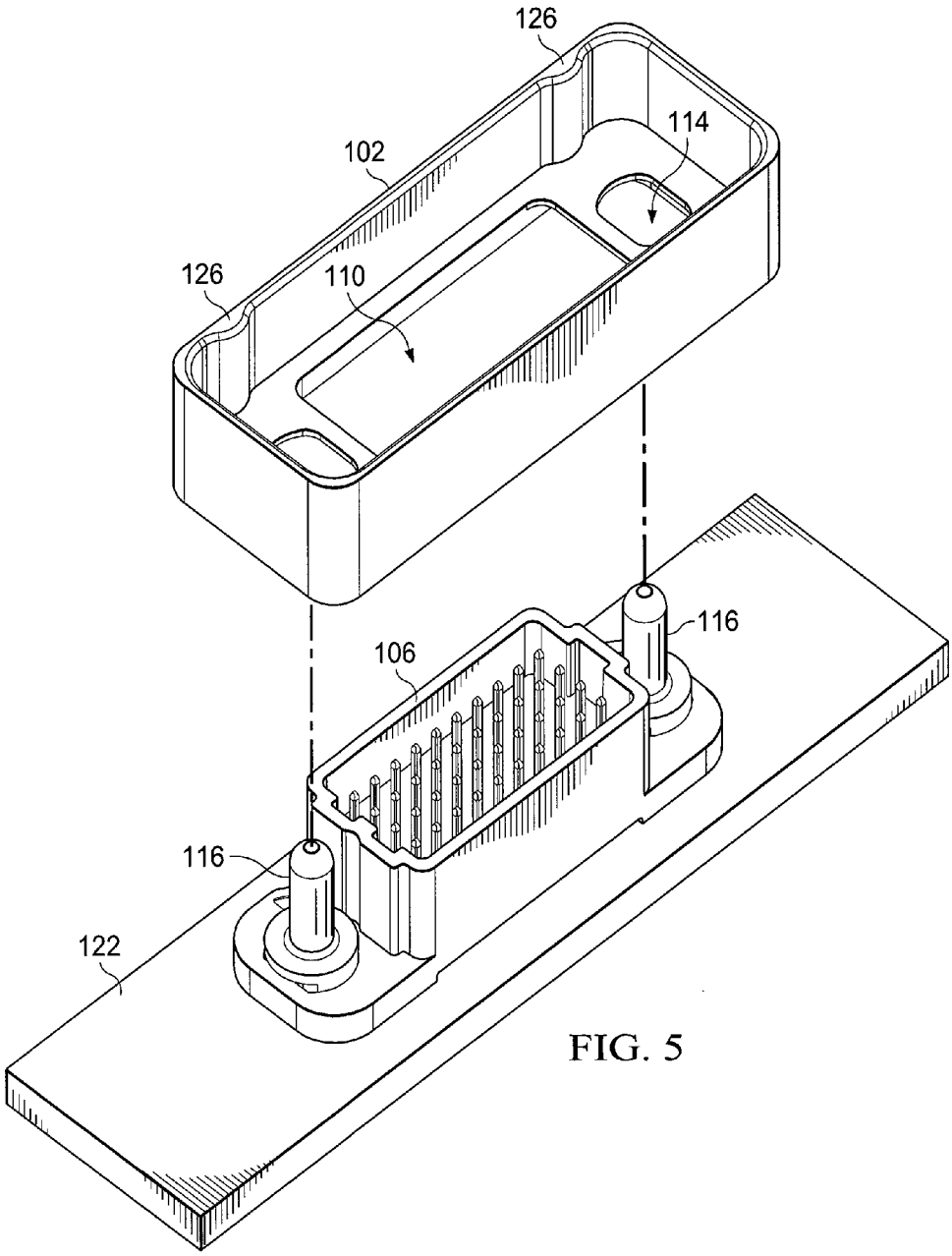
FIG. 5 is a top perspective view of a male connector hood portion removed from a male electrical connector mounted to a first board.
Figure 6:
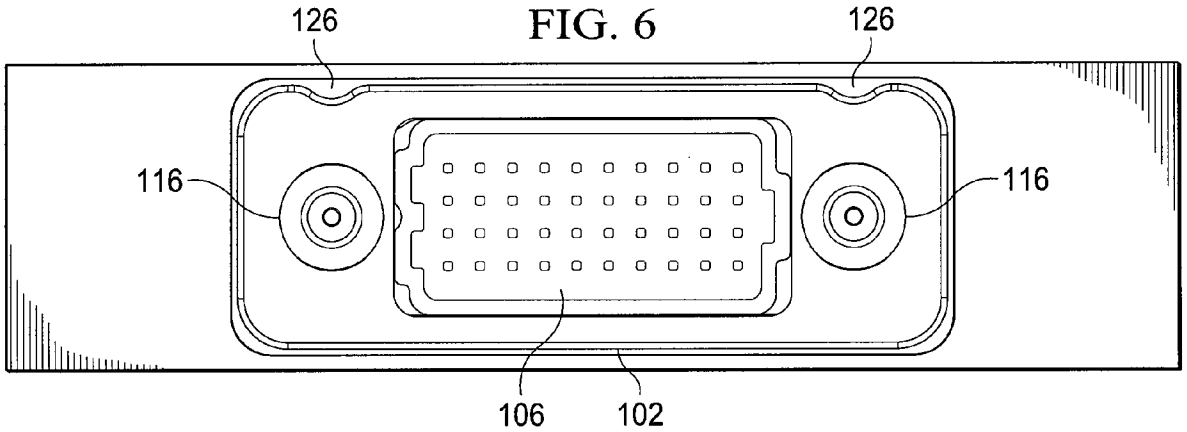
FIG. 6 is a top elevation view of a male connector hood portion installed on a male electrical connector mounted to a first board.
Figure 7:
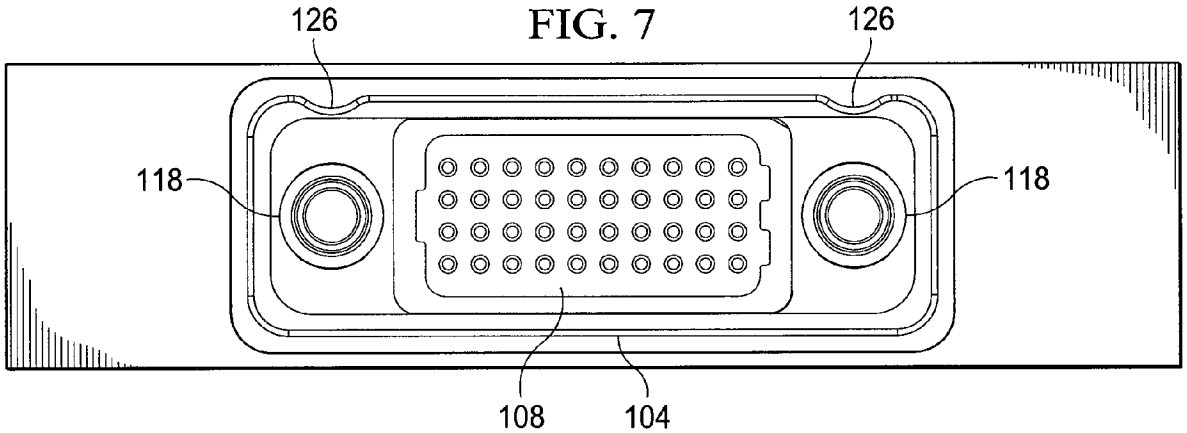
FIG. 7 is a top elevation view of a female connector hood portion installed on a female electrical connector mounted to a second board.

As shown in FIG. 1, a rugged hood assembly 100 comprises a male connector hood portion 102 and a female connector hood portion 104. As shown in FIG. 2, male connector hood portion 102 fits over male connector 106, which is secured to first board 122. As shown in FIG. 5, male connector 106 passes through male connector aperture 110 as male connector hood portion 102 is slipped on or off of male connector 106. Similarly, as shown in FIG. 3, female connector hood portion 104 fits over female connector 108, which is secured to second board 124. As shown in FIG. 4, female connector 108 passes through female connector aperture 112 as female connector hood portion 104 is slipped on or off of female connector 108. As shown in FIG. 4 and FIG. 5, male connector hood portion 102 and female connector hood portion 104 include fastening holes 114, through which various fastening structures, such as guide sockets 118 and guide posts 116 can also pass through fastening holes 114 during installation or removal. Additionally, as shown in FIG. 1, fastener 120 can secure the ends of guide posts 116 or guide sockets 118. As an alternative embodiment, male connector hood portion 102 could be disposed over female connector 108, and female connector hood portion 104 could be disposed over male connector 106.

Male connector hood portion 102 and female connector portion 104 can be any shape that corresponds to and allows them to fit over male connector 106 and female connector 108. As shown in FIGS. 1-7, male connector hood portion 102 and female connector portion 104 are desirably a generally rectangular shape with curved corners. As shown in FIGS. 2-7, male connector hood portion 102 and female connector portion 104 also desirably contain polarizing features 126. Polarizing features 126 help ensure that the connectors are mated in the proper orientation.

Rugged hood assembly 100 can be installed before or after mounting an electrical connector to a board, such as a printed circuit ("PCB") board. Rugged hood assembly 100 can be quickly and easily attached to or removed from the connector. Attaching and detaching can be accomplished, for example, by slipping the hood on or off of the connector after removing the fasteners. Rugged hood assembly 100 serves to protect the connector from harsh environments and physical damage due to rough handling, which may be encountered when using military equipment. Thus, the installation of rugged hood assembly 100 allows otherwise standard electrical connectors to conform to more stringent environmental conditions without the necessity of re-manufacture. Additionally, rugged hood assembly 100 provides electromagnetic interference ("EMI") shielding once installed. EMI can disrupt signals and degrade signal quality, and EMI shielding can help prevent such disruptions and signal degradation. Additional advantages of rugged hood assembly 100 include the ability to upgrade installed electrical connectors in the field without disassembling the connector from the PCB. Disassembly of the connector from the PCB is an expensive and risky operation because of the potential for damaging the PCB during disassembly and reassembly processes, including desoldering the original connector and resoldering a new connector. Rugged hood assembly 100 also provides additional structural integrity to reduce damage from vibration and debris.

The present invention can provide cost savings by allowing a manufacturer to benefit from economies of scale. Instead of investing in capital equipment designed to produce both standard connectors without metal shells and rugged electrical connectors with integral metal shells, a manufacturer can simply invest in one type of capital equipment for the production of standard electrical connectors, plus the minimal capital investment required to manufacture the rugged metal shells. A subset of the standard connectors can be transformed into rugged connectors by simply installing rugged hood assembly 100 of the present invention, which can be installed even after the mounting of the connector to a board.

To install rugged hood assembly 100, a user would place and fit male connector hood portion 102 over male connector 106 in such a manner as to cause male connector 106 to pass through male connector aperture 110, and would then cause guide posts 116 to pass through fastener apertures 114. Similarly, a user would place and fit female connector hood portion 104 over female connector 108 in such a manner as to cause female connector 108 to pass through female connector aperture 112, and would then cause guide sockets 118 to pass through fastener apertures 114. Then, a fastening structure, such as fastener 120, can be passed through each of the two guide pins 116 and each of the two guide sockets 118. After securing male connector hood portion 102 to male connector 106 and securing female connector hood portion 104 to female connector 108, the now-hooded electrical connectors can be mated together as they normally would. FIG. 1 depicts the resulting mated electrical connectors protected by rugged hood assembly 100.

To uninstall or remove rugged hood assembly 100, a user would first disconnect the two hooded portions from each other. Then, a user would remove any fastening structure, such as fastener 120, from each of the two guide posts 116 and each of the two guide sockets 118. Subsequently, guide posts 116 are removed by passing them through fastener apertures 114, and male connector hood portion 102 can be pulled off of male connector 106 in such a manner as to cause male connector 106 to pass through male connector aperture 110. Similarly, guide sockets 118 are removed by passing them through fastener apertures 114, and female connector hood portion 104 can be pulled off of female connector 108 in such a manner as to cause female connector 108 to pass through female connector aperture 112. With rugged hood assembly 100 removed, male connector 106 and female connector 108 could then be used as conventional electrical connectors.

When installed, rugged hood assembly 100 allows electrical connectors to be used in harsh or rugged environments. Such harsh environments often involve increased exposure to harmful factors such as debris, forceful impacts, heat, or inclement weather. These types of environments can be encountered in military or outdoor field situations.

First board 122 and second board 124 can be made of plastic, glass-epoxy, or any other suitable material that is capable of being molded or processed by standard PCB manufacturing processes and used as a mounting platform for an electrical connector. First board 122 and second board 124 can be printed circuit boards. A vertical board-mounted embodiment is described here, but rugged hood assembly 100 could be adapted to other types of connectors, such as cable connectors, right-angle mount, or straddle-mount connectors. Male connector hood portion 102 and female connector hood portion 104 can be constructed using metal or any other suitable material, including sturdy or durable materials that are capable of being molded.

The invention claimed is:

1. An attachable and removable protective rugged hood assembly for a pair of mating electrical connectors, comprising a male connector hood portion and a female connector hood portion, wherein each connector hood portion has an aperture through which an electrical connection portion of the connector passes, and wherein each said connector hood portion is attachable to and removable from the electrical connectors, the male connector hood portion on one of the mating electrical connectors being releasably interconnectable with the female connector hood portion on the other one of the mating electrical connectors, the electrical connection portion of the male connector hood portion comprising a plurality of pins and a protective shroud around the pins and the electrical connection portion of the female connector hood portion comprising a socket portion and a plurality of pin sockets in the socket portion, and the electrical connection portion passing through the male connector hood portion and the electrical connection portion passing through the female connector hood portion are enclosed within the hood portions when the male connector hood portion is releasably connected to the female connector hood portion.

2. An attachable and removable protective and rugged hood assembly for a pair of board-mounted electrical connectors, comprising a male connector hood portion and a female connector hood portion, wherein each connector hood portion has an aperture through which an electrical connection portion of each electrical connector passes, and wherein each connector hood portion is installed after each electrical connector is mounted to a board, the male connector hood portion on one of the mating electrical connectors being releasably interconnectable with the female connector hood portion on the other one of the mating electrical connectors, and the electrical connection portion passing through the male connector hood portion and the electrical connection portion passing through the female connector hood portion are enclosed within the hood portions when the male connector hood portion is releasably connected to the female connector hood portion.

3. The attachable and removable protective and rugged hood assembly of claim 2, where the connector hood portion can be removed from each electrical connector before the electrical connector is removed from the board.

4. A method for installing an attachable and removable protective rugged hood assembly on an electrical connector, comprising the steps of:

attaching a male connector hood portion to an electrical male connector;

attaching a female connector hood portion to an electrical female connector; and mating the hooded electrical male connector and the hooded electrical female connector such that the male connector hood portion of the electrical male connector is mated to the female connector hood portion of the electrical female connector and an electrical connection is established between the male and the female electrical connectors;

wherein the electrical male connector is pre-mounted to a board and the electrical female connector is pre-mounted to a board, and an electrical connection portion passing through the male connector hood portion and an electrical connection portion passing through the female connector hood portion are enclosed within the hood portions when the male connector hood portion is mated to the female connector hood portion.

5. A method for detaching an attachable and removable protective rugged hood assembly from an electrical connector, comprising the steps of:

disconnecting a hooded electrical male connector, comprising a male connector hood portion and an electrical male connector, from a hooded electrical female connector, comprising a female connector hood portion and an electrical female connector, such that the male connector hood portion of the electrical male connector is no longer connected to the female connector hood portion of the electrical female connector, and such that an electrical connection portion passing through the male connector hood portion and an electrical connection portion passing through the female connector hood portion are no longer enclosed within the hood portions;

detaching the male connector hood portion from the electrical male connector; and detaching the female connector hood portion from the electrical female connector;

wherein the electrical male connector is pre-mounted to a board and the electrical female connector is pre-mounted to a board.

6. A connector assembly, comprising:

a connector having an electrical connection portion protruding externally from the connector, the electrical connection portion configured to connect with a counterpart electrical connection portion of a counterpart connector;

a hood portion detachably mounted to the connector, the hood portion encircling the electrical connection portion of the connector when the hood portion is mounted to the connector, such that the electrical connection portion is enclosed within the hood portion when the connector is connected to the counterpart connector;

a connector aperture formed in the hood portion, the connector aperture receiving the electrical connection portion of the connector therein when the hood portion is mounted to the connector;

fastener apertures formed in the hood portion, the fastener apertures receiving guides therein when the hood portion is mounted to the connector;

wherein the connector aperture and the fastener apertures allow the hood portion to be detachably mounted to the connector; and wherein the connector is pre-mounted to a board.

7. The connector assembly of claim 6, further comprising a polarizing notch formed on the hood portion, the polarizing notch facilitating orientation of the connector when the connector is connected to another connector.

8. The connector assembly of claim 6, wherein the connector is a male connector, further comprising a guidepost disposed in the fastener apertures of the hood portion.

9. The connector assembly of claim 8, wherein the electrical connection portion comprises a plurality of pins protruding from the connector and a protective shroud around the pins.

10. The connector assembly of claim 6, wherein the connector is a female connector, further comprising a guide socket disposed in the fastener apertures of the hood portion.

11. The connector assembly of claim 10, wherein the electrical connection portion comprises a socket portion protruding from the connector and a plurality of pin sockets in the socket portion.

12. The connector assembly of claim 6, wherein the hood portion is compatible with and may be detachably mounted to either a male connector or a female connector.

13. The connector assembly of claim 6, wherein the hood portion provides EMI shielding for the connector when the hood portion is mounted to the connector.

* * * * *